United States Patent [19]

Chan

[11] Patent Number: 4,568,077

[45] Date of Patent: Feb. 4, 1986

[54] TOY AIRCRAFT

[76] Inventor: Peter Chan, 913 Bathurst St., Toronto, Ontario, Canada, M5R 3G6

[21] Appl. No.: 632,033

[22] Filed: Jul. 18, 1984

[30] Foreign Application Priority Data

Aug. 3, 1983 [CA] Canada ..... 433796

[51] Int. Cl.[4] ..... A63H 27/04

[52] U.S. Cl. ..... 272/31 A; 464/52; 464/58

[58] Field of Search ..... 272/31 A, 31 B, 31 P, 272/31 R; 446/30, 31, 32, 33, 34; 434/32, 33, 34; 74/12; 73/488; 15/104.3 SN; 464/179, 97, 66, 87, 92, 52, 57, 58, 53

[56] References Cited

U.S. PATENT DOCUMENTS

| | | | |
|---|---|---|---|
| 158,324 | 12/1874 | Starr | 464/57 |
| 1,323,964 | 12/1919 | Clegg | 464/52 |
| 1,364,203 | 1/1921 | Modlin | 446/32 X |
| 1,748,421 | 2/1930 | Leach | 272/31 A |
| 1,980,391 | 11/1934 | Eslinger | 272/31 A |
| 1,999,051 | 4/1935 | Kennedy | 464/58 |
| 2,158,577 | 5/1939 | Haley | 15/104.3 SN X |
| 2,901,251 | 8/1959 | Pettit | 272/31 B |
| 2,977,807 | 4/1961 | Conover | 464/53 X |
| 3,055,660 | 9/1962 | Alexander | 272/31 A |
| 3,596,399 | 5/1969 | Barbee | 272/31 A |
| 3,743,279 | 7/1973 | Chang | 272/31 A |

*Primary Examiner*—Robert A. Hafer
*Assistant Examiner*—Arnold W. Kramer
*Attorney, Agent, or Firm*—Bacon & Thomas

[57] ABSTRACT

A toy comprising a motor assembly mounted on an elevated support from which a toy aircraft is suspended by a flexible cable. The cable has a coiled wire sheath having one end connected to the support and the other to the aircraft. The cable hangs freely through a vertical passage in a bearing cup. A flexible shaft extends through the sheath from a driven connection from the motor to a driving connection with the propeller drive shaft. The drive shaft can be made up of a coiled spring encasing elastomeric cord serving to give it body and modify its resilience. The motor assembly may include an electric motor driven from a source of power through a speed control device and the speed of the assembly stepped up by a transmission of drive pulleys or gears. The aircraft is balanced by the way the flexible cable is connected to it and by downwardly and rearwardly angled tail wings to provide lift. When the propeller is actuated the aircraft describes orbits controlled by the cable operating in the bearing cup.

14 Claims, 8 Drawing Figures

FIG. 4.
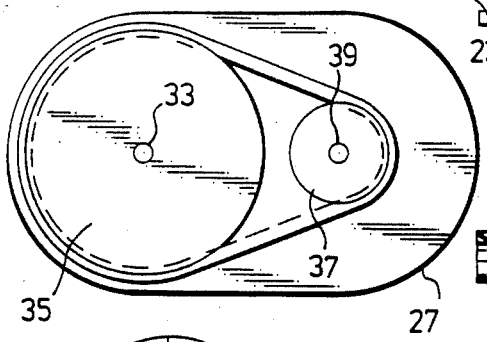
FIG. 5.
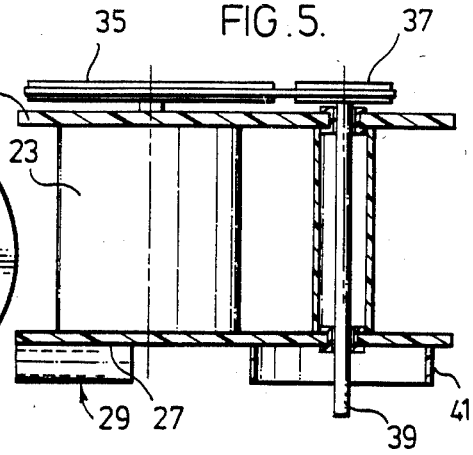
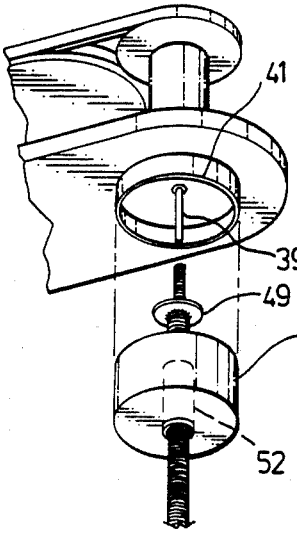
FIG. 7.
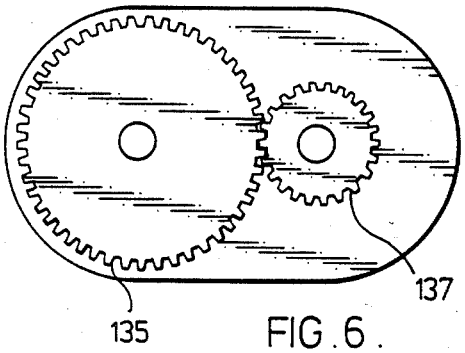
FIG. 6.
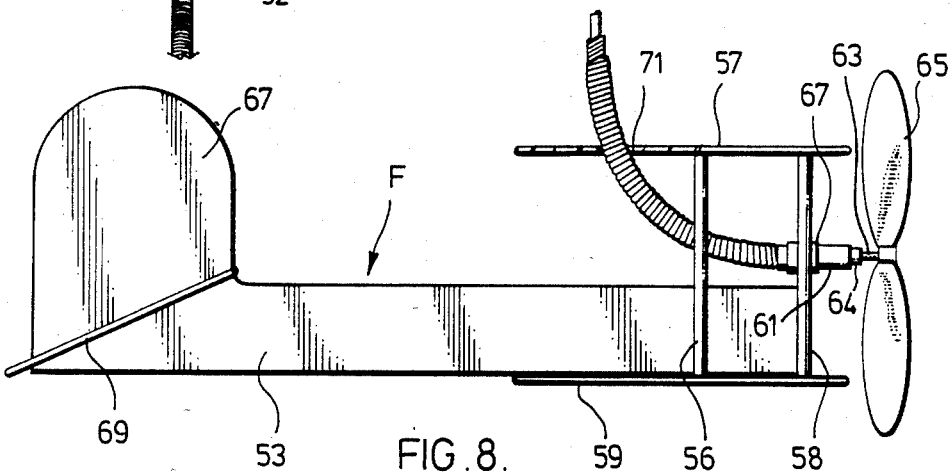
FIG. 8.

TOY AIRCRAFT

FIELD OF THE INVENTION

This invention relates to an aircraft toy.

SUMMARY OF THE INVENTION

The toy is made up of a motor assembly mounted on an elevated support adapted for retention at a height with flying space beneath it. Preferably, the motor is an electric motor having a drive shaft connected to a driven shaft through a speed increasing transmission of pulleys or gears. The toy aircraft is suspended from the support by a flexible cable. The flexible cable has a sheath, preferably of coiled wire, having its upper end fixedly connected to the support and its lower end centrally connected to the aircraft and extending to a fixed connection with its propeller housing. A flexible shaft extends through the sheath and is rotatable in it. The flexible shaft has its upper end coupled to the driven shaft in the motor assembly and its lower end coupled to the propeller drive shaft of the plane and the cable passes through a passage in annular horizontal bearing means extending downward from the support.

Preferably, the flexible shaft is made up of a spirally coiled wire snugly encasing elastomeric cord serving to give it body and modify its resilience.

The motor assembly preferably includes an electric motor connected with a source of electricity through a speed control device. This enables the aircraft to be flown at different speeds through a circular flight path determined by its suspension from the stand by the flexible cable.

The aircraft is maintained horizontal, in flight, by the combination of its construction being a pair of forward wings and a tail wing which is angled downwardly and rearwardly, with the particular way in which it is suspended by the flexible cable extending through the rear of the upper forward wing. Lift is provided by the slip-stream encountering the angled tail wings. The propeller is rotated causing forward movement of the aircraft, centrifugal force and wing lift causes it to fly outward in generally circular orbits controlled by the retention of the upper end of the cable within said bearing means.

Other features of the construction will be apparent from the detailed description to follow.

BRIEF DESCRIPTION OF THE DRAWINGS

The invention will now be described in more detail by reference to the accompanying drawings illustrating a preferred embodiment:

FIG. 4 is a top plan view of the motor assembly and transmission from the driven motor shaft for the flexible cable;

FIG. 5 is a fragmentary side elevation, showing the motor assembly;

FIG. 6 is a plan view of an alternative transmission arrangement to that of FIG. 4;

FIG. 7 is a fragmentary perspective exploded view showing the coupling assembly between the flexible cable and the driven shaft and retainer arrangement for the end of the sheath;

FIG. 8 is an enlarged side elevation showing the toy aircraft and the flexible cable connection to the pulley.

DESCRIPTION OF THE PREFERRED EMBODIMENT

Figure 1:
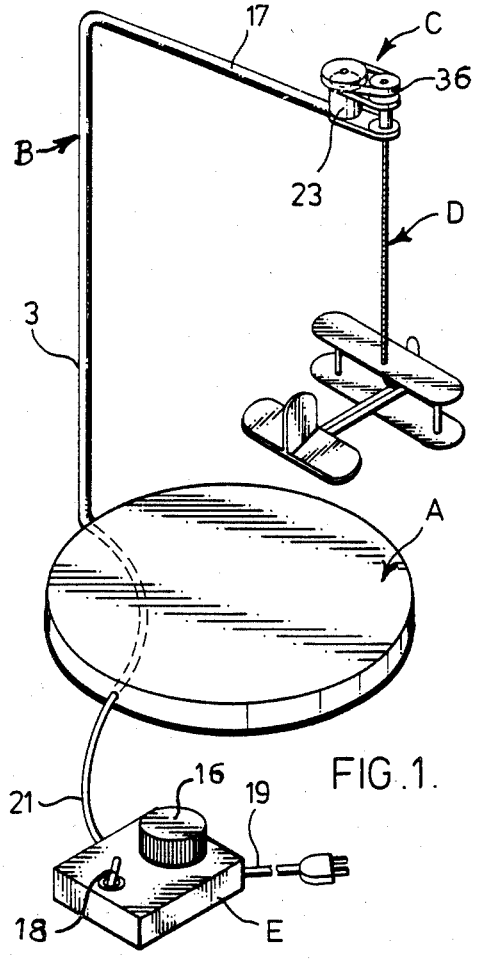
FIG. 1 is a perspective view showing a general arrangement of the toy and accompanying equipment.

Referring more particularly to FIG. 1 of the drawings, the general arrangement of the toy is as follows.

A is a stationary base supporting a standard B having a vertical leg 3 and a horizontal arm 17 extending therefrom.

A motor and transmission assembly C is arranged on an elevated stand 27 on the end of the arm 17 as will be described in more detail.

A flexible cable indicated generally by D extends downwardly from the assembly C to a connection with a toy aircraft which will be described in more detail.

E represents a speed control device which is in the form of a rheostat having a control knob 16 and switch 18. The device E is capable of adjustment to control current to the motor to provide low, medium and high speeds. The device E receives its power through a line 19 either from a battery or from a normal electrical supply. The speed control device E is connected by an electrical cable 21, which extends through the standard B to a connection with the motor assembly C.

The motor assembly C is made up of a lower platform 27 with a socket 29 to receive the end of the arm 17. A set screw may be applied to secure the end of the arm 17 in the platform 27. An electric motor 23 is mounted on the platform 27. An upper platform 31 is mounted on top of the motor and has a part projecting forward therefrom. The motor 23 drives a shaft 33 on which there is mounted a large pulley 35, which through an elastic belt 36, drives a smaller pulley 37 on the shaft 39 at a higher speed.

FIG. 6 shows, in plan, an alternative arrangement in which gears 135 and 137 are employed in the place of the pulley drive of FIG. 4.

The shaft 39 extends downward through the plateform 27 and projects therebeyond. An inverted cup 41 has its bottom connected to the bottom of the base 27, which is provided with a central opening through which the shaft 39 projects with a skirt projecting downward from the platform 27. The shaft 39 receives the end of a flexible drive cable 43 as will be described. The cable 43 includes a sheath 45, which is a spiral metal coil. Rotatable within the sheath, substantially coextensive therewith, is a flexible cable made up of a coil of metal 43 which snugly surrounds a solid elastomeric core 47 which tends to stiffen it and give it body without removing its flexibility.

A washer 49 is fixed to the end of the sheath 45. A cup 51 engages over the skirt of the cup 41 in a push fit. When the cup 51 is in engagement with the cup 41 the flexible cable is coupled to the end of the shaft 39, which engages it in a push fit and the upper end of the sheath 45 is retained by the washer 49 bearing on the base of the cup 51.

An alternative construction is as follows. A sleeve 52 has a push fit in the opening in the bottom of the cup 51 and this sleeve extends upward within this cup and surrounds the flexible cable. The washer 49, on the end of the outer spring 45, seats on the top end of the tube 52. Depending on the adjustment of this tube, the washer can either be up against the floor of the inverted cup or further down. In either construction the passage through the base of the cup provides bearing means through which the cable passes and against which the sheath bears.

Suspended on the lower end of the cable D is a toy aircraft, preferably made of wood or plastic. The craft has a fuselage 53, an upwardly extending centrally arranged forward strut 58 and spaced-apart rear struts 56, a lower wing 59 is mounted on the bottom of the fuselage and an upper wing 57 on the top of the struts 58 and 56. A propeller shaft housing 61 is mounted on the strut 58. There extends forward therefrom, through the housing 61, a propeller shaft 63 which carries a propeller 65 of metal or plastic.

The aircraft is also provided with a tail 67. A tail wing 69 extends laterally therefrom in each direction. The wing 69 is inclined at a downward and rearward angle which will tend to cause the tail to be forced upward by the slipstream as the aircraft moves forward through the air so as to keep the craft more or less horizontal.

Figure 2:
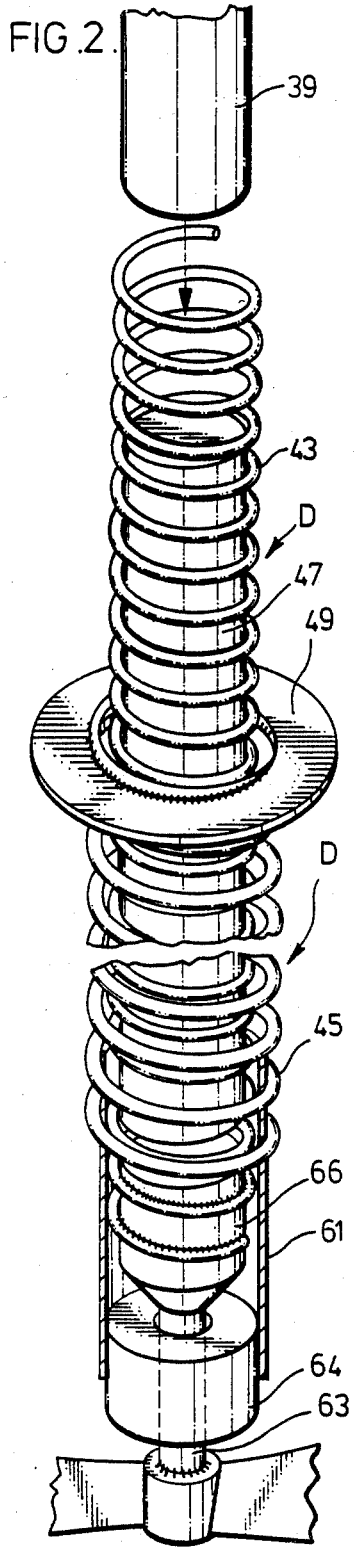
FIG. 2 is a greatly enlarged fragmentary perspective view showing the flexible cable (and its core and sheath) for transmitting the motion from the motor to the propeller of the aircraft and its driven and driving couplings.
Figure 3:
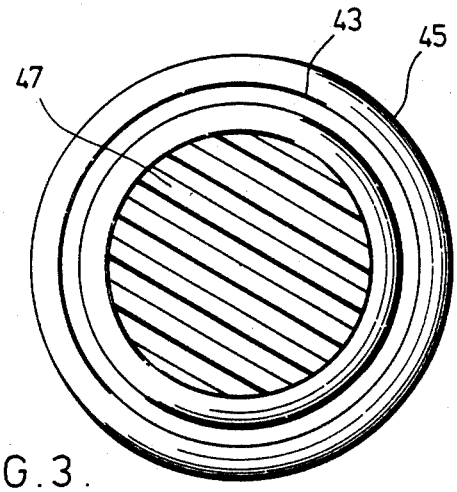
FIG. 3 is a cross-section through the flexible cable core and sheath as shown in FIG. 2.

The drive connection of the cable D and the aircraft propeller is shown in FIG. 2. A propeller shaft housing tube 61 extends through the strut 58 and is held thereto by a collar 67. The terminal end of the cable sheath 45 has a push fit on the rear end of the housing 61 protruding rearwardly beyond the strut 58. The propeller shaft 63 is rotatable in a collar or bearing 64 which has a push fit in the end of the propeller shaft housing tube 61. A lump of solder 66 surrounds the rear end of the propeller shaft 63 and the terminal end of the cable coil 43 surrounds the solder and is held to it.

The flexible cable D passes freely into the aircraft through an opening 71 centrally arranged through the rear of the wing. The entry of the cable into the aircraft at this position is important to maintain proper fore and aft balance of the aircraft.

OPERATION

Operation of the toy aircraft is as follows.

The motor 23 is started by adjusting the speed control device E so that the shaft 33 is rotated at a speed determined by the setting of the speed control. The shaft 39 is rotated through the transmission described at a speed considerably greater than that of the motor shaft 33.

The rotary motion of the shaft 39 is transmitted through the flexible cable D to the propeller 65.

The rotation of the propeller 65 pulls the aircraft forward in a flight path determined by its suspension from the flexible cable D and the speed of the motor 23. The suspension of the craft by the positioning of its connection to the cable D and the angle of the wing 69 maintains the fore and aft inclination of the aircraft substantially horizontal during simulated flight. As the lower end of the cable D is carried outward by the movement of the aircraft, it bears against the bearing means provided by the passage through the base of the cup 51.

It should be observed that, in order to maintain proper balance, so that the plane is kept substantially level fore and aft, the way in which it is suspended by the flexible cable extending through a central opening at the rear of the top wing and thence forward to the propeller housing is important. This way of suspension combines with the angle of the tail rearwardly and downwardly so that lift is imparted to the tail by the slipstream. The applicant has also found it desirable, for maintaining balance, to have upper and lower forward wings.

The elastic cord is placed within the inner spring by pulling it around progressively between the coils.

The applicant has found that a six-volt motor is satisfactory when using the speed increasing mechanism disclosed.

It is also found that the size of the coil wire sheath 45 can be about the size of the spring in a ballpoint pen, while the center wire coil 43 is of the size of a spring from a cigarette lighter.

The toy can be driven by direct current from a twelve-volt battery or from the house circuit through a transformer.

I claim:

1. An aircraft toy, comprising, an elevated support providing beneath it flying space, a motor assembly mounted on said support and having a drive shaft extending therefrom, annular downwardly directed bearing means extending downwards from said support and provided with a passage, a toy aircraft having a propeller connected to a propeller drive shaft and provided with wings, a flexible cable including a sheath having an upper end rotatably connected to said support and a lower end connected to the aircraft whereby the latter is suspended by said sheath from the stand, a flexible shaft extending through and enveloped by said sheath and rotatable therewithin and having an upper end having a driven connection from said motor assembly drive shaft and a lower end having a driving connection with the propeller drive shaft, the cable sheath and enclosed flexible shaft passing through said passage with the sheath in operative contact with said bearing means and hanging freely downward therefrom, whereby the aircraft is suspended so that when the propeller is actuated, forward movement of the aircraft is induced and centrifugal force and wing lift causes it to fly outward in generally circular orbits governed by the retention of the upper end of the cable in said bearing means.

2. An aircraft toy, as defined in claim 1, in which the cable sheath is a spiral coil of wire and the flexible cable is an inner smaller spiral coil of wire rotatably mounted therein and having terminal ends projecting from each end of the sheath.

3. A toy, as defined in claim 2, in which the inner coil snugly encases an elastomeric cord serving to give it body and modify its resilience.

4. A toy, as defined in claim 1, in which the propeller drive shaft is rotatable in a housing and the lower end of the cable sheath is fixedly attached to the housing and the lower end of the flexible shaft is fixedly coupled with the rear end of the propeller shaft.

5. An aircraft, as defined in claim 1, in which the motor assembly includes an electric motor having a drive shaft, a large pulley on said drive shaft, a driven shaft spaced from said drive shaft with said driven shaft being said drive shaft to which said flexible shaft is connected and a drive belt surrounding said pulleys whereby the smaller pulley is driven from the larger pulley.

6. A toy, as defined in claim 1, in which the motor has a drive shaft and a large gear mounted on said shaft, a driven shaft having a smaller gear mounted on it and meshing with said first gear whereby there is a speed increase in the motor drive shaft and the driven shaft with said driven shaft being said drive shaft to which said flexible shaft is connected.

7. A toy, as defined in claim 1, in which said support includes a platform, a shaft driven from said motor extending downwardly through an opening in said platform to project from the lower surface thereof, an annular frame mounted on the underside of the platform to surround said driven shaft, a cup member having a skirt surrounding said frame in a push fit, said cup member having a base including a central opening, said flexible cable sheath extending through said opening and having on its end laterally extending retaining means for engaging said base of said cup, said flexible shaft having its end forming a coupling with the end of the driven shaft.

8. A toy, as defined in claim 1, in which the motor is an electric motor, a speed control device is connected to the motor and the speed control device to a source of electric current.

9. A toy, as defined in claim 1, in which the aircraft has an elongated fuselage having a rear end on which there are mounted extending downwardly and rearwardly extending rear wings which respond to the slipstream in lifting the tail of the craft.

10. A toy, as defined in claim 1, in which the aircraft has an elongated fuselage carrying a wing structure including lower and upper wings and a forward support extending between the wings, the propeller shaft housing is mounted in said support, the flexible cable extends downwardly through a central opening in the rear of the top wing forward to a connection to the propeller housing thereby to suspend the aircraft in a substantially horizontal plane.

11. A toy, as defined in claim 1, in which said support includes a platform, a shaft driven from said motor extending downwardly through an opening in said platform to project from the lower surface thereof, an annular frame mounted on the underside of the platform to surround said driven shaft, a cup member having a skirt surrounding said frame in a push fit, said cup member having a base including a central opening, a sleeve mounted in said opening an extending thereabove, said flexible cable sheath extending through said sleeve and having on its end laterally extending retaining means for engaging the end of the sleeve, said flexible shaft having its end extending beyond the cable sheath and forming a coupling with the end of the driven shaft.

12. A toy as defined in claim 1, in which the motor is an electric motor and driven through a speed control device electrically connected to a source of electricity.

13. A toy, as defined in claim 1, wherein the flexible shaft is an elongated inner spiral wire coil extending between a driven end and a driving end and enclosing an elastomeric core stopping short of each end to provide a short free length of the coil as a coupling.

14. A toy, as defined in claim 13, in which a heavier coil of wire surrounds the inner coil as a sheath and extends through a major part of its length and stops short of the coupling portion at each end, the driven end of the flexible shaft being coupled to a driven shaft of the motor assembly and a driving end being coupled to the propeller shaft.

* * * * *